US005718378A

United States Patent [19]

Dupre

[11] Patent Number: 5,718,378

[45] Date of Patent: Feb. 17, 1998

[54] CONTROL SYSTEM FOR SNOW MAKING DEVICES

[76] Inventor: Herman K. Dupre, c/o Seven Springs, Champion, Pa. 15622

[21] Appl. No.: 633,128

[22] Filed: Apr. 16, 1996

Related U.S. Application Data

[63] Continuation-in-part of Ser. No. 534,837, Sep. 27, 1995, Pat. No. 5,628,456.

[51] Int. Cl.[6] ..... F25C 3/04

[52] U.S. Cl. ..... 239/14.2; 239/414; 137/607; 137/869; 251/58

[58] Field of Search ..... 239/2.2, 14.2, 239/412, 414, 415, 417.5; 137/869, 894, 607; 251/58

[56] References Cited

U.S. PATENT DOCUMENTS

| | | | |
|---|---|---|---|
| 2,794,447 | 6/1957 | Spitz | 137/894 X |
| 3,801,062 | 4/1974 | Arn et al. | 251/58 X |
| 3,814,319 | 6/1974 | Loomis | 239/2 S |
| 4,194,535 | 3/1980 | Galland et al. | 239/414 X |
| 4,545,529 | 10/1985 | Tropeano et al. | 239/2 |
| 4,634,050 | 1/1987 | Shippee | 239/14.2 |
| 4,635,852 | 1/1987 | Muhlnickel, Jr. | 239/414 |
| 4,717,072 | 1/1988 | Girardin | 239/415 X |
| 4,749,127 | 6/1988 | Ash | 239/14.2 |
| 5,031,832 | 7/1991 | Ratnik et al. | 239/14.2 |
| 5,154,348 | 10/1992 | Ratnik et al. | 239/14 |
| 5,360,163 | 11/1994 | Dupre | 239/14 |
| 5,400,966 | 3/1995 | Weaver et al. | 239/14.2 X |
| 5,538,184 | 7/1996 | Karbanowicz et al. | 239/14.2 |

FOREIGN PATENT DOCUMENTS

| | | |
|---|---|---|
| 0479641A1 | 9/1991 | European Pat. Off. . |
| 2623276 | 5/1989 | France . |

*Primary Examiner*—Andres Kashnikow
*Assistant Examiner*—Robin O. Evans
*Attorney, Agent, or Firm*—Carothers & Carothers

[57] ABSTRACT

A snow making system which includes a snow making device adapted to produce a spray of artificially manufactured snow from a combination of compressed air and water supplied under pressure to the device from remote compressed air and water supplies. A control system is provided at each snow making device which includes air and water valves that are operatively connected between the snow making device and respective supplies of compressed air and water for controlling the supply of air and water to the snow making device. The air and water valves are ganged together for simultaneously valving of the air and water supply and these valves are further adapted for draining water from the connected snow making device when the valves are in their off position. An air operated drive is connected for actuating the ganged valves simultaneously and is connected to the air supplied under pressure for maintaining the ganged valves on when the pressure of the supplied air is above a predetermined minimum.

22 Claims, 5 Drawing Sheets

CONTROL SYSTEM FOR SNOW MAKING DEVICES

CROSS REFERENCE

This patent application is a continuation-in-part of U.S. patent application Ser. No. 08/534,837, now U.S. Pat. No. 5,628,456, filed on Sep. 27, 1995, in the name of Herman K. Dupre for BELOW SURFACE CONTROL SYSTEM FOR SNOW MAKING DEVICES.

BACKGROUND OF THE INVENTION

This invention relates to the art of making snow for ski resorts and the like. More particularly, it relates to improvements in apparatus utilized to control snow making devices for manufacturing snow for ski resorts.

It is well known that ski resorts utilize a series of snow towers and/or snow guns on the ski slopes in order to manufacture snow with the combined use of water under pressure and compressed air in subfreezing conditions.

Ski resorts maintain crews of equipment operators whose job it is to travel the mountain sides to turn the snow making equipment on or off and to make other adjustments as required in order to maximize the manufacture of man-made snow and to minimize waste of such manufactured snow. This requires the operator to move from snow making tower to tower or gun to gun in order to adjust or turn on and off the air and water valves supplying the respective snow making devices.

These exposed valves are generally mounted adjacent each snow tower on an air-water hydrant and are therefore subject to freezing and jamming due to freezing. They also present a year-around unwanted obstruction.

Additionally, the operator usually travels from tower to tower by snowmobile or an all-terrain vehicle and the setup at each tower is such that the operator is required to park and get off his vehicle, approach the tower and then free the water and air valves from snow and ice which are covering them and then manipulate each valve independently.

When there are many towers or snow guns on the ski slopes to maintain, this operation requires more than a considerable amount of the operator'time. In addition, the valves and/or lines may be found in a frozen condition and additional labor has to be expended in unfreezing the valve so that they can be manipulated.

Also, if the snow making device is being turned off, an additional drain valve must either be mined on or the water line actually disconnected from the hydrant to drain all water from the snow making device. Moisture can also accumulate in the air supply line and generally it must be also drained in order to prevent freeze-up in the supply lines from the hydrant to the snow making device. This all, of course, requires an unreasonable amount of expended labor which is costly.

In addition, when an operator disconnects the water and air supply lines which lead from the hydrant to the snow making device for draining the same when turning it off, the water and air supply lines can be easily mixed up and connected to the wrong supply upon reconnection and activation of the tower. The result is that the operator moves on and does not realize at the time that the snow making device is not operating correctly and that it is merely providing unwanted ice conditions on the ski slope.

Another major drawback of the snow making systems of the prior art for ski resorts is that in the off ski season when it is desired to use the ski slopes for other activities such as hiking or summer down-hill sports or activities, the hydrants of the prior art still protrude above ground as a hazardous condition as do the snow making towers or equipment itself. The hydrants are also expensive to manufacture.

It is a principal object of the present invention to provide a snow making system for ski resorts which in the off season leaves no objectional hazardous protrusions extending above the ski slope ground surface and provides a protected control system therefore which can be very easily and quickly attended to by an operator, remotely operated and prevents freeze-up of the valves and additionally automatically drains the snow making device when it is in an off condition.

SUMMARY OF THE INVENTION

The snow making system of the present invention includes a snow making device, such as a tower or gun, which is adapted to produce a spray of artificially manufactured snow from a combination of compressed air and water supplied under pressure from remote compressed air and water supplies. Air and water valves are operatively connected between the snow making device and the respective supplies of compressed air and water for controlling the supply of air and water to the snow making device.

The air and water valves are ganged together for simultaneous valving of the air and water supply and these valves are adapted for draining water from the connected snow making device when the valves are in their off position.

An air operated drive, such as a piston cylinder combination, is connected for actuating these ganged valves simultaneously and connected to the air supplied under pressure for maintaining the ganged valves on when the pressure of the supplied air is above a predetermined minimum.

An air control valve is preferably operatively connected between this air operated drive and the air supplied under pressure for selectively connecting the drive to the air supplied under pressure. This permits selective automatic or alternatively manual operation of the ganged valves. The air control valve is also a three way valve whereby it is adapted for draining air and water remaining in the air operated drive when the control valve is in an off position, which requires manual operation of the ganged valves.

The ganged valves include a single handle connected for simultaneous manual operation of the valves. A lock mechanism is provided for selectively locking the handle in an off or on position. This locking mechanism is further adapted to cause the handle to be in different positions of orientation when locked in the on and off positions or not locked for automatic operation, such that these different positions of orientation for the handle indicate to the attending operator respectively when the mechanism is locked on or off or is not locked and is in the automatic operation mode.

It is preferred that the ganged valves be enclosed in a below ground control pit which has a removable access lid and a bottom water drain mechanism for draining off water. The handle for manual operation is exposed through and above the lid for manual manipulation. The handle may be extended in length above the lid for access thereto when snow accumulation on the ground surface becomes excessive.

While the system of the present invention will work well with any snow making device, it is preferably adapted for and utilized with number of stationary snow making towers arranged on the ski slope.

The pipes or conduits utilized to connect the ganged valves to the snow making device are preferably meatal, such as aluminum, so that as they extend upward through the lid of the underground control pit, they engage each other for heat transfer for preventing the air pipe from freezing. These hydrant pipes upwardly terminate above the control pit with 45° connection air and water elbows for hose connection to the snow making device. This arrangement permits full gravity draining of the snow making device when the ganged valves are in their off position, as no accumulation of water is permitted anywhere in the system during the draining process. In addition, the hydrant air elbow is positioned directly above the hydrant water elbow for heat transfer which also assists in preventing the air connection from freezing.

It is preferable that a male hose connector be provided on one of the air and water elbows and a female hose connector be provided on the other elbow for thereby preventing reverse connection of air and water hoses for the snow making device. Removable caps are also provided to close off these hose connectors when the snow making devices are not in use.

In order to keep the underground control pit sufficiently warm so that pipes do not freeze, insulation may be disposed in the pit enclosure and in addition the air and water supplied under pressure to the pit is preferably supplied with aluminum piping, at least in the pit enclosure area, for maximum heat transfer.

As previously explained, the system may be operated in automatic mode wherein the snow making devices are turned off when a predetermined minimum air pressure is attained. Generally this minimum air pressure is adjusted to be approximately eighty pounds per square inch, as air pressures less than this are not sufficient for the artificial manufacture of snow.

The air control valve may be electrically operated by a remotely located electric control or computer connected for actuating the air control valve. In addition this valve may also be manually operated to a permanent on or off condition at the site of each snow making device. A water pressure regulator valve may also be provided at each snow making device location so that the water supply may be regulated, as by gate valves, to regulate the pressure of the water supplied from the water supply to the respective snow making devices. This permits fine regulation for the snow making capabilities at different locations along the ski slope. For example, under the existing ambient conditions, it may be preferable to supply less water pressure at the base of the mountain or ski slope than at the top, as obviously under normal conditions the water pressure at the bottom of the mountain which is supplied to the snow making devices would be much greater than that the water under pressure supplied to the snow making devices at the top of the mountain or ski slope.

In order to automatically close the ganged valves when the air pressure supplied is less than the aforesaid predetermined minimum, a spring is positioned and adapted to close the ganged valves when the air drive is no longer under sufficient operation pressure to oppose the spring and maintain the valves in their open position. Different springs of different spring tension may be substituted for thereby regulating the predetermined minimum air pressure at which the system will automatically shut down.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 1:
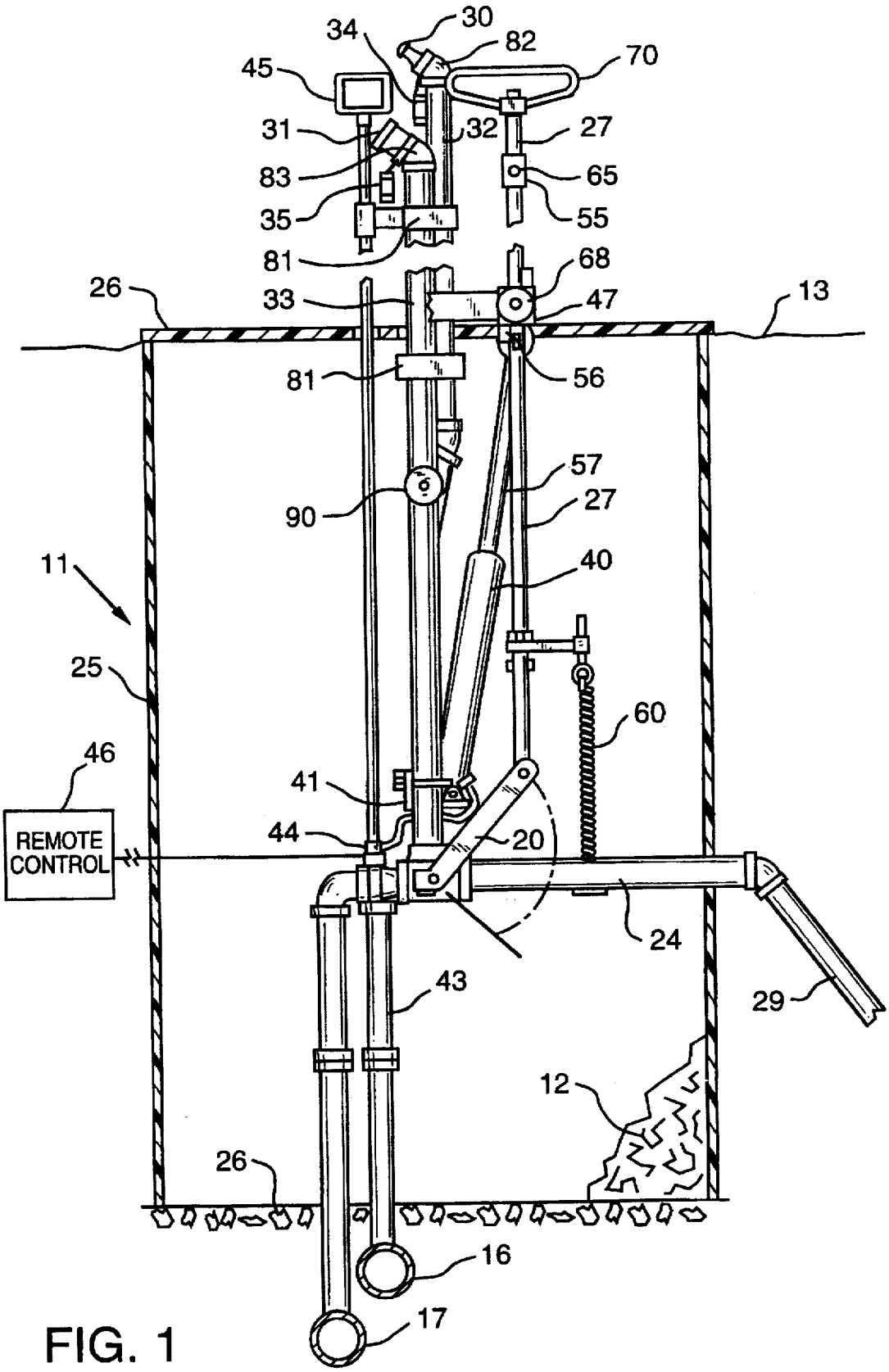
FIG. 1 is a view in front elevation, with portions sectioned away, illustrating the control system of the present invention.
Figure 2:
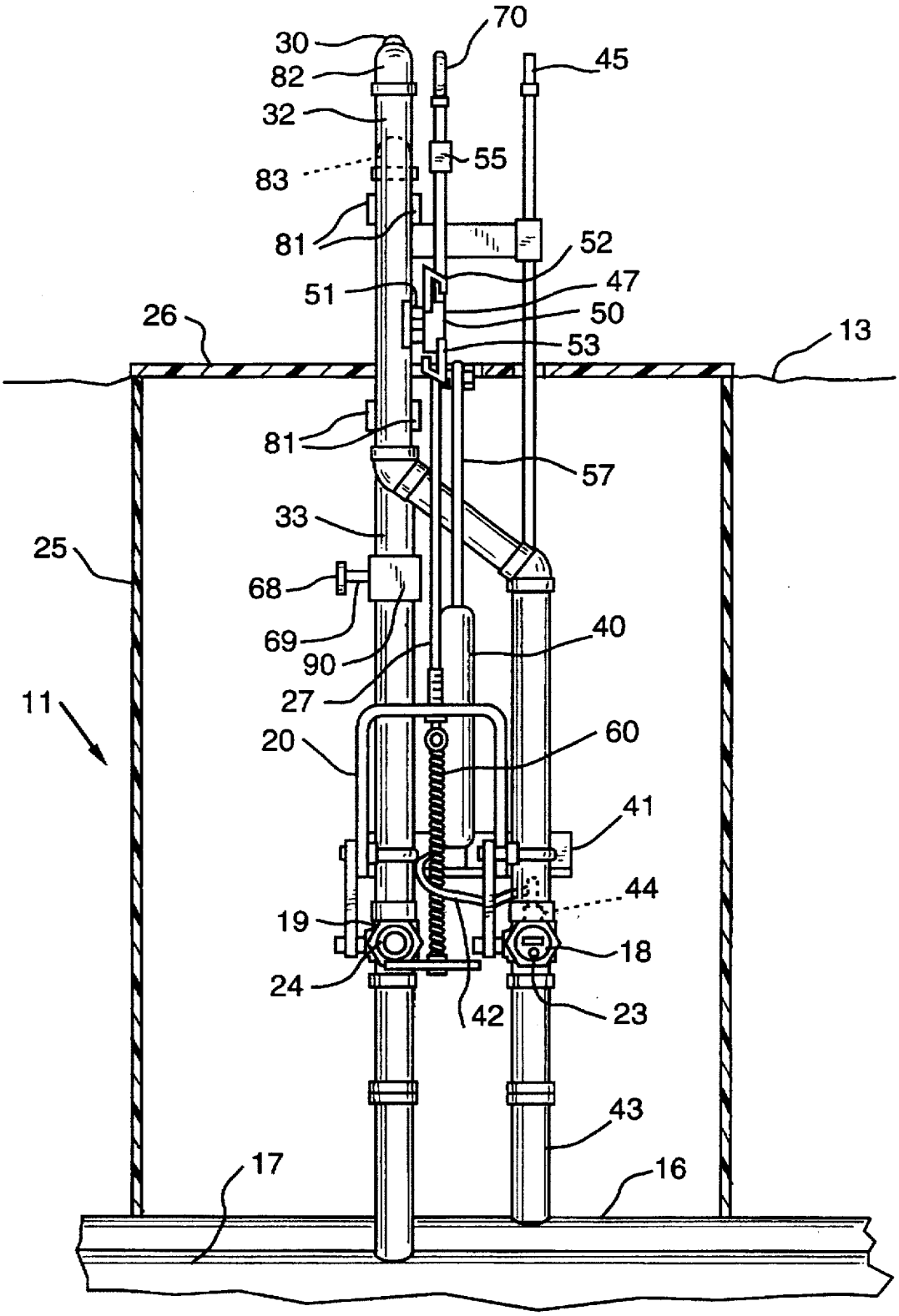
FIG. 2 is a view in side elevation of the control system shown in FIG. 1.
Figure 3:
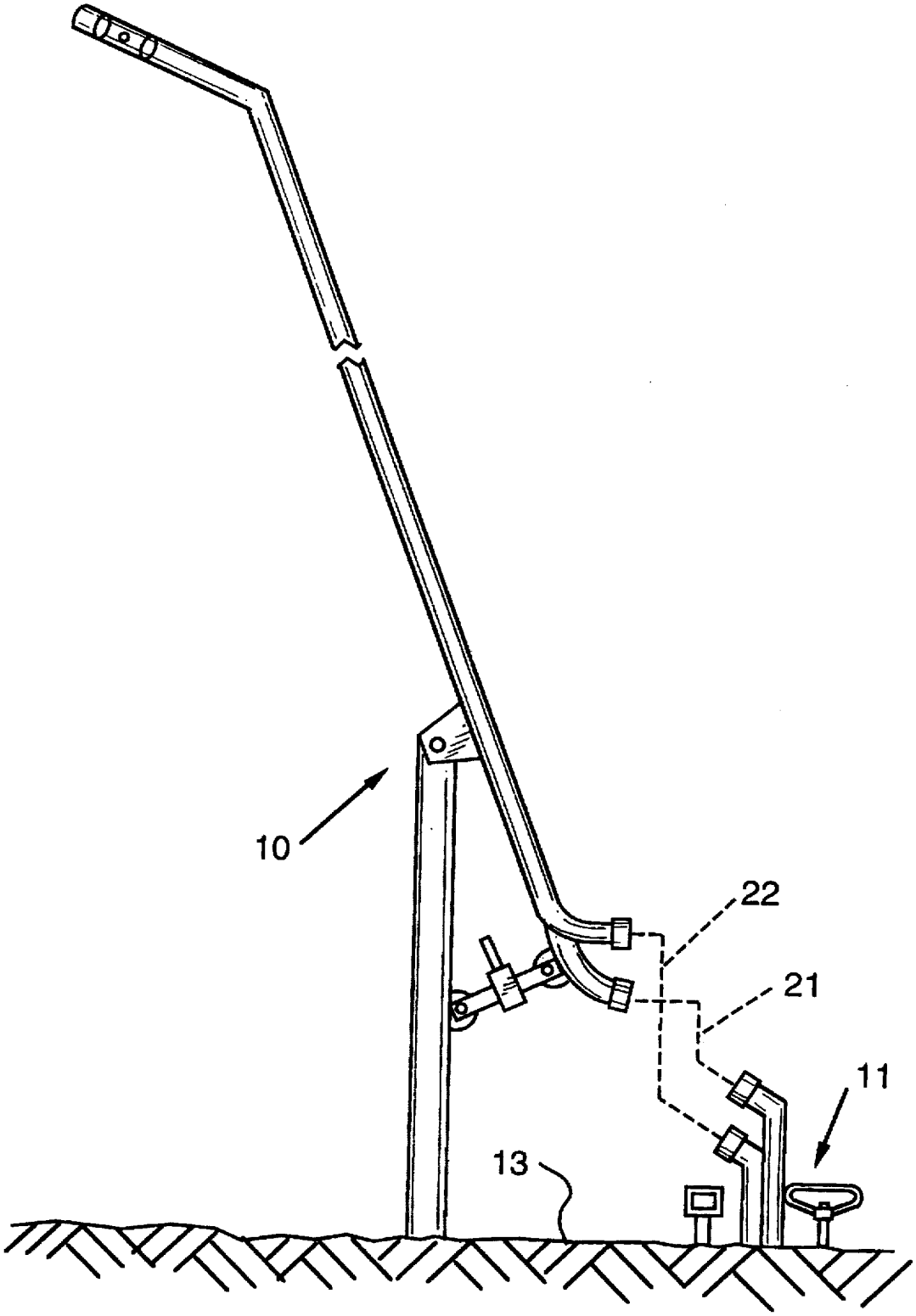
FIG. 3 is a diagrammatic-schematic view of the control system of the present invention shown in FIGS. 1 and 2 illustrated in combination with a snow making tower.

Referring first to FIGS. 1, 2 and 3, a snow making system is illustrated wherein a snow making device in the form of a snow making tower 10 (see FIG. 3) is illustrated in combination with an air and water control feed mechanism 11 which supplies the snow tower 10.

The snow making tower 10 is of the same type illustrated in Dupre U.S. Pat. No. 5,360,163 and is removably embedded in the ski slope ground surface 13.

Compressed air and water under pressure are respectively provided from remote locations and in conventional fashion to snow tower 10 through underground lines 16 and 17. These lines continue on to other controls 11 along the ski slope for supplying additional snow towers 10.

The supply of air and water to snow tower 10 from the respective air and water line 16 and 17 is controlled respectively by three-way valves 18 and 19. These valves are ganged together by double operating arm 20 for simultaneous operation or valving of the air and water supply. Adjustable stops for arm 20 may be provided for upper and lower swing limits as required and as illustrated in my copending application.

Each of these three-way valves 18 and 19 is adapted for draining water from snow tower 10 to respective air and water connection hoses 21 and 22 (schematically illustrated in FIG. 3) by respective drains 23 and 24 when valves 18 and 19 are in their off position. Hoses 21 and 22 may extend as far as desired above lid 26 for connection to tower 10. Typical lengths of extension are 5 to 6 feet.

Valves 18 and 19 are housed in underground control pit enclosure 25 which is basically a plastic cylinder constructed of any suitable plastic, such as, polyurethane of polyvinyl chloride. Pit enclosure housing 25 is also provided with a mating cap or lid 26 to close off the top. The bottom 26 is gravel or crushed stone for drainage to prevent water accumulation. The enclosure 25 may be filled with insulation, such as rock wool 12 to help prevent freeze-up in the enclosed valves and pipes.

A single control handle 27 is removably connected to control lever 20 to simultaneously operate valves 18 and 19 above ground by manipulation of the handle. When handle 27 is in the up position as shown, the three-way valves 18 and 19 are on and water and air under pressure are being supplied through hoses 21 and 22 from exposed hydrant pipes 32 and 33 to snow tower 10. When the valves are off, water drains out of air connection hose 21 through drain 23 and out of water connection hose 22 through water drain 24. Air drain 23 is restricted so that the air contained therein under very high pressure does not escape too fast and thereby disturb the interior of enclosure 25 and undesirably blow off lid 26. Drain pipe 29 which is connected to drain 24, drains off the water to a location outside enclosure 25 so that the enclosure is not unduly flooded. this permits gravity drainage of all water (approximately 10 gallons) from tower 10 through connection hose 22 to an outside downhill location.

Handle 27 is exposed through and above lid 26 for manipulation, and hydrant pipes 32 and 33 are also exposed through and above lid 26 for respective connection to snow tower 10 via hoses 21 and 22.

The exposed air coupling 30 of air hydrant pipe 32 is a male coupler part and the exposed coupling 31 for water hydrant pipe 33 is a female coupling part so that it is impossible for the operator to inadvertently reverse connection of the lines to snow tower 10. By using a male coupler 30 for the air line, it has been found that the air coupling seal ring (not shown) is not inadvertently blown out on disconnect and lost. Also, couplings 30 and 31 may be located within enclosure 25, instead of above lid 26 if so desired. The couplings 30 and 31 are conventional quick-connect and disconnect couplings such as manufactured under the trademark EVERTITE. The couplings are also provided with respective end caps 34 and 35, which hang nearby for ready access to cap off the couplings 30 and 31 when not in use.

In the spring, summer and fall seasons, or the off ski season, the handles 27 and 45 can be quickly disconnected and dropped down into housing or enclosure 25 for storage until needed again in the winter. In a similar fashion, hydrant pipes 32 and 33 can also be readily adapted to be disconnected and stored in the pit during the off season.

In this situation, the top 26 remains on the enclosure 25 and presents a continuous above ground surface without hazardous protrusions projecting therefrom. Accordingly, when snow tower 10 is removed and handles 27 and 45, and hydrant pipes 32 and 33 are removed, a nonhazardous ground surface is provided which is usable for summer downhill activities. Alternatively, an extra plastic bubble cover (not shown) may be provided to cover over the remaining parts exposed above lid 26.

An air operated drive 40, provided in the form of an air operated cylinder and piston combination, is connected between control arm 27 and a stationary support base 41 for actuating the ganged valves 18 and 19 simultaneously when the pressure of the supplied air, supplied through line 16, is above a predetermined minimum.

Air under pressure to operate drive 40 is supplied via hose 42 from air line 16 through lower air hydrant pipe 43. The supply of this air under pressure from line 43 through hose 42 is controlled by air valve 44. Air valve 44 is solenoid operated and can be either controlled independent and manually at its location through exposed control handle 45 or remotely through a computer or other electric or electronic control 46.

When air control valve 44 is turned to its off position by handle 45, the snow tower 10 cannot be turned on, except manually through manipulation of handle 27. If air control valve 44 is on, tower 10 will automatically be turned on by turning on ganged valves 18 and 19 simultaneously when minimum air pressure is attained thereby extending the piston cylinder arrangement 40 to lift arm 20 and simultaneously actuate both air and water valves 18 and 19.

Air control valve 44 is also a three-way valve so that when it is in its off position, all moisture or condensation or water contained in air drive 40 is automatically gravity drained therefrom into pit enclosure 25.

A lock mechanism 47 is provided for selectively manually locking control arm or handle 27 in an off or on position for the respectively ganged and control valves 18 and 19. Details of lock mechanism 47 are more readily apparent in FIGS. 4 and 5.

The locking mechanism 47 consists of three basic parts, a main body sleeve 50 (which is rigidly secured to water hydrant pipe 33 through support arm 51), upper hook arms 52, and lower hook arms 53. Control arm 27 is free to slide up and down through the cylindrical hollow interior 54 of body sleeve 50.

Upper and lower stops 55 and 56 respectively are positioned and secured to control arm 27.

Figure 4:
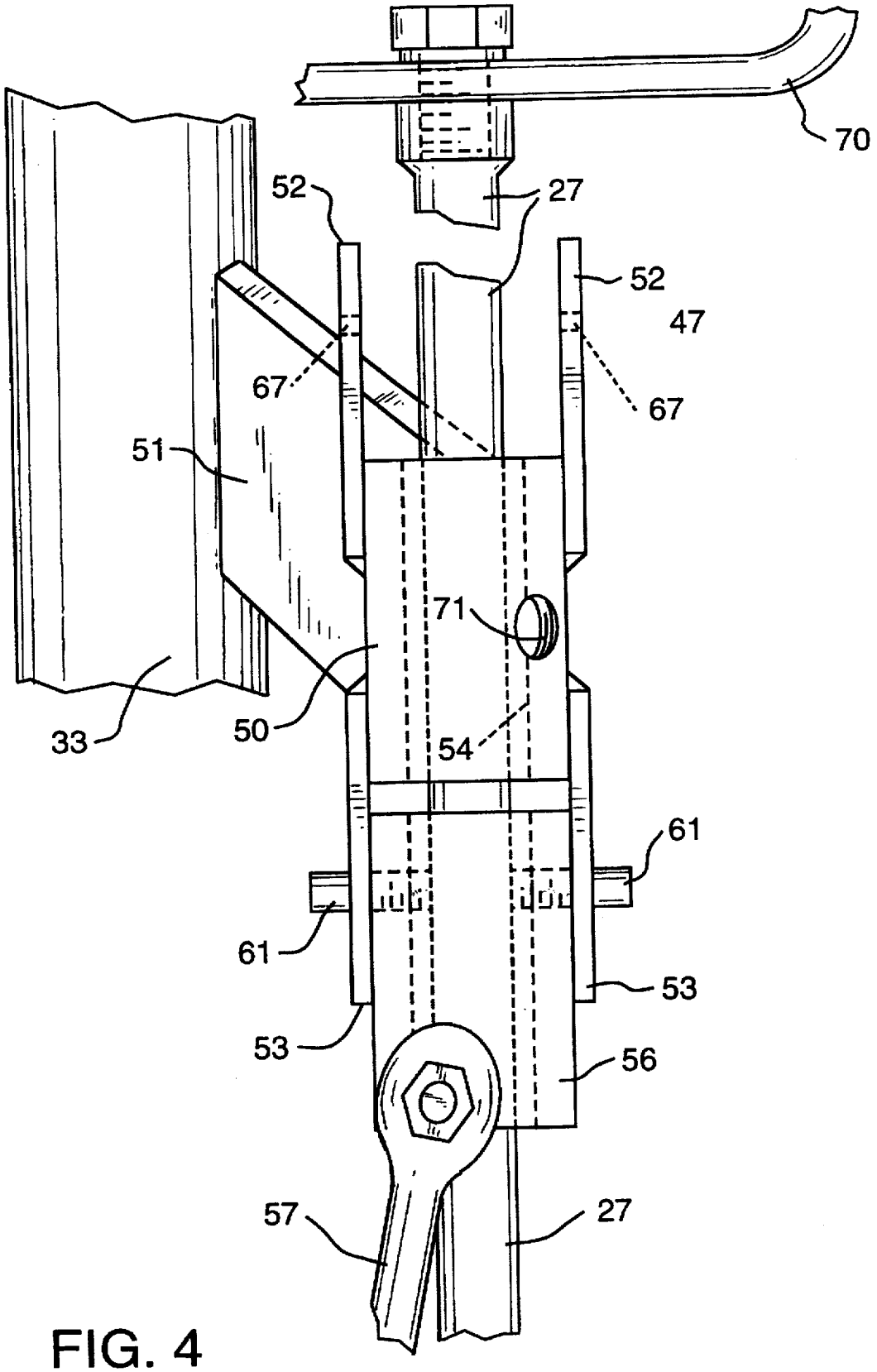
FIG. 4 is an enlarged perspective view illustrating the detail of the control arm locking mechanism for the control system illustrated in FIGS. 1 and 2.
Figure 5:
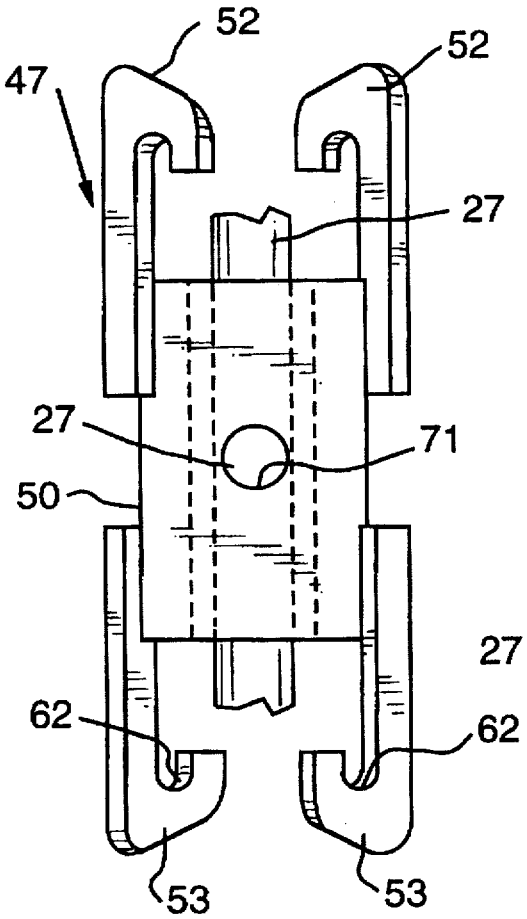
FIG. 5 is a view in end elevation of the control arm locking mechanism illustrated in FIG. 4.

When the ganged valves 18 and 19 are turned on automatically by the air operated drive 40, the piston arm 57 thereof extends and forces handle 27 upwardly until bottom stop 56 engages the bottom of lock sleeve 50 as illustrated in FIGS. 1, 2 and 4. The valves are then in their full on position.

When the air supplied under pressure through line 16 reaches a predetermined minimum, of say 80 psi, the air pressure within the cylinder of air drive 40 will sufficiently decrease so that tension spring 60 is sufficient to draw control arm 27 downwardly and force piston rod 57 into the cylinder of air drive 40 to collapse the drive and to thereby lower dual arm 20 and close off both air and water valves 18 and 19 simultaneously. The lower most limit of downward extension for control arm 27 is limited by the contact of upper stop 55 against the top of sleeve 50 of lock mechanism 47.

In automatic operation as just described, the upper handle portion 70 will be oriented, when viewed from the top thereof, at a 45° position of orientation between the full left position shown in FIGS. 1 and 2 and a locked off position. In FIGS. 1, 2 and 4, the ganged valves 18 and 19 are locked mechanically in an on position so that regardless of what air pressure is within the system, the system is maintained in an on condition.

Bottom stop 56 is provided with two extension locking pins 61 which extend laterally on opposites sides therefrom. As previously described, the bottom end of locking mechanism body sleeve 50 is provided with two downwardly depending hook arms 53 which are provided with respective hook pin receiving recesses 62.

In order to lock the control in an on position, control arm 27 is raised upward fully until stop 56 engages the bottom of body sleeve 50. At that point, control handle 70 is rotated full left or counterclockwise until pins 61 engage and drop into recesses 62 of bottom hooks 53. Handle 70 is then oriented in a full left position and the control is locked on. This full on condition is indicated readily to a passing service technician or operator upon viewing orientation of the handle 70 to a full left position.

To the contrary, the control can be locked in a full off position by lowering lever control arm 27 to its full extent until upper stop 55 engages the top of lock mechanism body sleeve 50. At this point the handle 70, together with control arm 27, is rotated full right or clockwise so that the respective pins 65 of upper stop 55 engage against upper hooks 52, such that the pins 65 are aligned with hook recesses 67. In this position, if the air drive 40 attempts to turn the control valves 18 and 19 on, the control arm 17 will move upwardly and pins 65 will engage into upper hook recesses 67 preventing the control arm 27 to rise any further. This mechanically maintains the tower in an off condition until the control arm is mechanically released from the locking mechanism 47.

To ensure locking mechanism 47 is maintained in an off or on position, handle 68 is turned clockwise so that its threaded stem 69 engages handle shaft 27 to lock it in place. Stem 69 threadably engages passage 71 in sleeve 50. Handle 68 and its stem 69 are not shown in FIGS. 4 and 5 for clarity.

Thus when handle 7 is seen to be oriented in its full left or counterclockwise position, the operator knows that the system is locked on. If handle 70 is oriented 90° to the right or to the full clockwise position, then the operator knows that the control is locked off. If the surface technician observes that the handle is in between these positions, then he knows that the control is in automatic and is being operated automatically by the air drive 40, assuming air control valve 44 is on.

Figure 6:
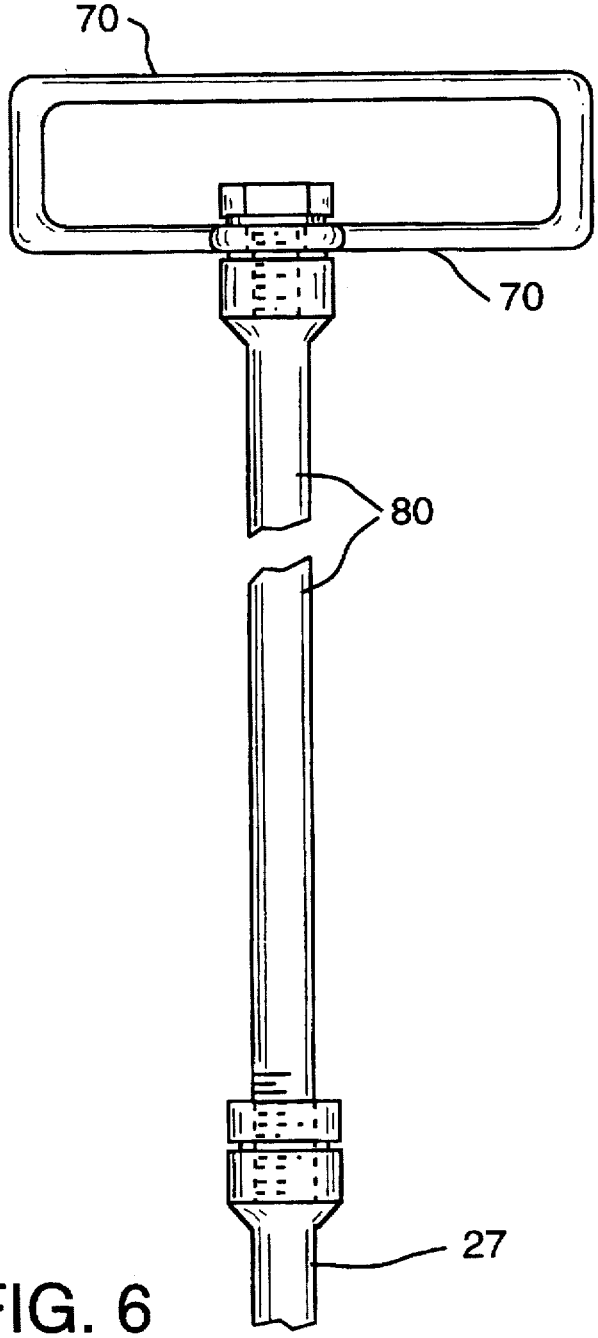
FIG. 6 is an enlarged view in from elevation illustrating an extension arm for the control arm and handle mechanism utilized in the control system shown in FIGS. 1 and 2.

In the event that snow buildup is extensive on top of ground surface 13, an extension handle 70 may be provided for control arm 27, as is illustrated in FIG. 6. A similar handle extension may also be provided for air control arm 45. This extension 80 merely threads at opposite ends into the existing handle 70 and control arm 27.

The hydrant air and water pipes 32 and 33 are metallic, and preferably aluminum, and are engaged with each through welded heat transfer plates 81 so that heat transfers from the water pipe to the air pipe to prevent freezing. In addition, the hydrant pipes upwardly terminate with 45° connection air and water elbows 82 and 83. This arrangement permits hoses 21 and 22 to be fully positioned above pipes 32 and 33 so that there is full gravity draining of all water from snow tower 10 when the ganged valves 18 and 19 are in their off position. In addition, hydrant air elbow 82 with its corresponding coupler 30 is positioned directly above the hydrant water elbow 83 with its respective coupler 31 so that upwardly rising heat is transferred from the water coupling to the air coupling in order to further assist in preventing freeze-up of the air coupling.

All piping within the closure 25 is preferably metal and more preferably aluminum in order to provide for maximum heat transfer within the enclosure 25 to prevent freeze-up.

The predetermined minimum air pressure for automatically actuating the control was before described as being approximately 80 pounds per square inch. The reason for this is that when the air pressure drops below 80 psi, snow can no longer be artificially manufactured with the snow making device 10.

However, other air pressures may be selected for automatically turning on and turning off the control. This can be easily regulated by changing spring 60 so that springs of different spring tension thereby regulate the predetermined minimum air pressure at which air drive 40 will be able to turn on ganged valves 18 and 19.

Sometimes, it is desired to have means for controlling the water pressure at each snow making device location along the ski slope. For example, when the water is supplied under pressure up the ski slope through line 17, obviously the water pressure will be greater at the bottom of the mountain ski slope than it will be at the top.

Therefore, in order to provide a means for independently regulating the air pressure at each control station 11, a water gate valve 90 is provided in the water hydrant line 33. In this manner, the water pressure supplied to each snow tower 10 may be independently regulated.

I claim:

1. In a snow making system including a snow making device adapted to produce a spray of artificially manufactured snow from a combination of compressed air and water supplied under pressure thereto from remote compressed air and water supplies, air and water valves operatively connected between said snow making device and the respective supplies of compressed air and water for controlling the supply of air and water to the snow making device, said air and water valves ganged for simultaneous valving of the air and water supply and said valves adapted for draining water from the connected snow making device when said valves are in their off position, the improvement comprising; an air operated drive connected for actuating said ganged valves simultaneously and connected to said air supplied under pressure for maintaining said ganged valves on when the pressure of said supplied air is above a predetermined minimum.

2. The snow making system of claim 1, including an air control valve operatively connected between said air operated drive and said air supplied under pressure for selectively connecting said drive to said air supplied under pressure for selective automatic or manual operation of said ganged valves.

3. The snow making system of claim 2, wherein said air control valve is a three way valve adapted for draining air and water remaining in said air operated drive when said control valve is in an off position thereby requiring manual operation of said ganged valves.

4. The snow making system of claim 2, said ganged valves including a single handle connected for simultaneously manually operating said ganged valves.

5. The snow making system of claim 4, including a lock mechanism for selectively locking said handle in an off or on position for said ganged valves.

6. The snow making system of claim 5, wherein said locking mechanism is adapted to cause said handle to be in different positions of orientation for indicating respectively when said ganged valves are locked on or off or not locked for automatic operation.

7. The snow making system of claim 4, including a control pit enclosure adapted for enclosing said ganged valves below a ground surface and having a removable access lid and bottom water drain mechanism for draining off water, said handle exposed through and above said lid for manual manipulation.

8. The snow making system of claim 7, including extension means adapted for extending the length of said handle above said lid.

9. The snow making system of claim 7, wherein said snow making device is a snow making tower.

10. The snow making system of claim 7, including metal air and water hydrant pipes connecting said ganged valves to said snow making device, said pipes extending upward through said lid and engaging each other for heat transfer therebetween for preventing said air pipe from freezing.

11. The snow making system of claim 10, said hydrant pipes upwardly terminating with 45° connection air and water elbows for hose connection to said snow making device for providing full gravity draining of said snow making device when said ganged valves are off.

12. The snow making system of claim 11, wherein the hydrant air elbow is positioned directly above the hydrant water elbow for heat transfer.

13. The snow making system of claim 12, including a male hose connector on one of said air and water elbows and a female hose connector on the other elbow for preventing reversed connection of air and water hoses for said snow making device.

14. The snow making system of claim 13, including removable caps for said hose connectors for capping them off when not in use.

15. The snow making system of claim 6, including insulation disposed in said pit enclosure.

16. The snow making system of claim 6, wherein said air and water supplied under pressure is supplied with aluminum pipe, at least in said pit enclosure, for maximum heat transfer.

17. The snow making system of claim 1, wherein said predetermined minimum air pressure is approximately eighty pounds per square inch.

18. The snow making system of claim 1, wherein said air drive is an air operated piston-cylinder arrangement.

19. The snow making system of claim 1, wherein said air control valve is electrically operated and including a remote electric control connected for remotely actuating said air control valve.

20. The snow making system of claim 1, including a water pressure regulator valve on said water supply and adapted for regulating the pressure of the water supplied from said water supply to said snow making device.

21. The snow making system of claim 1, including a spring which is positioned and adapted for closing said ganged valves when the air pressure supplied is less than said predetermined minimum.

22. The snow making system of claim 21, wherein said spring is adapted for replacement by a spring of different spring tension for regulating said predetermined minimum air pressure.

* * * * *